US010293979B2

(12) United States Patent
Fee et al.

(10) Patent No.: US 10,293,979 B2
(45) Date of Patent: May 21, 2019

(54) THUMB HOLE PAINT CONTAINER AND HOLDER

(71) Applicant: Nova Wildcat Shur-Line, LLC, Mooresville, NC (US)

(72) Inventors: Garry C Fee, Huntersville, NC (US); John C Morphey, Concord, NC (US)

(73) Assignee: NOVA WILDCAT SHUR-LINE LLC, Mooresville, NC (US)

( * ) Notice: Subject to any disclaimer, the term of this patent is extended or adjusted under 35 U.S.C. 154(b) by 71 days.

(21) Appl. No.: 15/400,695

(22) Filed: Jan. 6, 2017

(65) Prior Publication Data

US 2017/0197759 A1 Jul. 13, 2017

Related U.S. Application Data

(60) Provisional application No. 62/276,613, filed on Jan. 8, 2016.

(51) Int. Cl.

| | |
|---|---|
| ***B65D 25/30*** | (2006.01) |
| ***B44D 3/12*** | (2006.01) |
| ***B44D 3/14*** | (2006.01) |

(52) U.S. Cl.

CPC ..... *B65D 25/30* (2013.01); *B44D 3/126* (2013.01); *B44D 3/128* (2013.01); *B44D 3/14* (2013.01)

(58) Field of Classification Search

CPC ..... B44D 3/14; A47G 23/0266; B65D 25/24; B65D 25/30

USPC ..... 220/570

See application file for complete search history.

(56) References Cited

U.S. PATENT DOCUMENTS

| | | | | | |
|---|---|---|---|---|---|
| 3,491,976 | A * | 1/1970 | Larson | A47B 13/16 | 215/393 |
| 4,960,225 | A * | 10/1990 | Gillis | A47G 23/0266 | 215/395 |
| 4,998,696 | A * | 3/1991 | Desjardins | B44D 3/12 | 220/737 |
| 5,651,254 | A * | 7/1997 | Berry | F25C 1/22 | 62/1 |
| 5,806,709 | A * | 9/1998 | Marshall, II | B44D 3/14 | 220/755 |
| 2009/0032542 | A1 * | 2/2009 | Temple | B65D 25/30 | 220/669 |

* cited by examiner

*Primary Examiner* — Shawn M Braden

(74) *Attorney, Agent, or Firm* — McGuireWoods LLP

(57) ABSTRACT

An improved paint container is disclosed. A paint container which may be a tray or an edger tray, is shown having two halves each being configured to hold and contain a liquid. The paint container may have a plurality of walls to form reservoirs therebetween, and a base. The two halves may be separated by an elevated member such as a ridge forming two reservoirs. The elevated member may have a rounded surface for permitting scraping of a pad or brush. In another embodiment, a can holder may include at least one opening that may be formed in a lower section of a base portion. The at least one opening may be as many as four holes and sized to accept fingers of a user. The plurality of holes may be configured and located below a thumb hole. The holes may be recessed permitting near simultaneous insertion of a thumb and fingers into the respective holes.

5 Claims, 6 Drawing Sheets

THUMB HOLE PAINT CONTAINER AND HOLDER

CROSS-REFERENCE TO RELATED APPLICATIONS

This application claims benefit and priority to U.S. Provisional Application No. 62/276,613 filed Jan. 8, 2016, the disclosure of which is incorporated by reference herein in its entirety.

FIELD OF DISCLOSURE

The present disclosure relates generally to a paint container and, more particularly, to a paint container with improved usability including an easy to control thumb carry hole and/or finger holes.

BACKGROUND OF THE DISCLOSURE

Paint containers or holders for use in painting typically have limited features for ease of use. Paint containers are often used to hold a variety of fluids and flowable materials such as, for example, paint, water, oil, and the like. Paint containers are available in a wide array of sizes and shapes to meet various industrial needs. One issue with such containers are that it they often are difficult to simultaneously hold and use the container with ease.

Accordingly, there exists an unfulfilled need for a paint container, holder or tray with an improved usability that can be used to apply, e.g., a paint or other liquid in an efficient manner with an improved control and handling.

SUMMARY OF THE DISCLOSURE

According to an aspect of the present disclosure, a container is provided comprising a container body that comprises a plurality of walls and a base, an elevated member extending from a first wall of the plurality of walls to a second wall of the plurality of walls forming a first reservoir with a third wall of the plurality of walls and the base and forming a second reservoir with a forth wall of the plurality of walls and the base, a cavity formed in the elevated member forming an opening in the first wall, the second wall or both the first wall and the second wall, the opening configured of sufficient diameter to receive a thumb therein. The cavity may have a diameter selected from a range from about ½ inch to about 1½ inches.

In one aspect, a container is provided comprising a container body that comprises a base having a vertical extension extending from the base about a circumference of the base, the vertical extension sized to accept a can therebetween to provide stability to the can, a cavity formed in the base extending across a width of the base configured of sufficient diameter to receive a thumb therein, wherein the diameter is about the same as a diameter of a quart can or a gallon can.

In one aspect, a container comprising a container body includes a plurality of walls and a base, an elevated member extending from a first wall of the plurality of walls to a second wall of the plurality of walls forming a first reservoir with a third wall of the plurality of walls and the base, and forming a second reservoir with a fourth wall of the plurality of walls and the base, a cavity formed in the elevated member forming an opening in the first wall, the second wall or both the first wall and the second wall, the opening configured of sufficient diameter to receive a thumb therein.

The first reservoir and the second reservoir may be of equal area. The elevated member may include a scraping edge extending from the elevated member. The scraping edge may be a triangular shape and formed along an entire length of the elevated member from the first wall to the second wall. At least one reservoir may have an inclined floor. The elevated member may comprise a concave radius and a convex radius. The cavity may be formed by two separate pieces that mate to create the cavity.

In one aspect, a container may comprise a container body that comprises a base having at least one vertical extension extending from the base about a circumference of the base; the vertical extension sized to accept a can therebetween to provide stability to the can, a cavity formed in the base extending across a width of the base configured of sufficient diameter to receive a thumb of a user therein, wherein the diameter is about the same as a diameter of a mating quart can or a mating gallon can permitting acceptance of the mating can therein. The at least one vertical extension may comprise a plurality of vertical extensions arranged in pairs with one vertical tab opposing a second vertical tab of a pair across the base from one another and configured to hold a can of liquid therein by friction fit. The at least one vertical extension may be a continuous vertical extension extending vertically from a circumference of the base and configured to hold a can of liquid therein by friction fit. The cavity may be sized to accept a thumb of a user. The cavity may be sized to accept four fingers of a user.

In one aspect, a container comprising a container body that includes a plurality of walls, a base having a lower portion configured to store paint and a higher portion configured to be used as a roller area by a paint roller and a cavity formed in the base extending across a width of the base proximate the lower portion and the cavity configured of sufficient diameter to receive a thumb therein. The cavity may extend across an entire width of the base along a wider width of the lower portion. The cavity may extend across a portion of the lower portion across a shorter width of the lower portion. A second cavity may be formed along the higher portion. A second cavity may be formed proximate a retaining member, the retaining member is an L-shaped member formed extending vertically downward from an end of the higher portion.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description serve to explain the principles of the disclosure. No attempt is made to show structural details of the disclosure in more detail that may be necessary for a fundamental understanding of the disclosure and the various ways in which it may be practiced. In the drawings.

DETAILED DESCRIPTION OF THE DISCLOSURE

The disclosure and the various features and advantageous details thereof are explained more fully with reference to the non-limiting embodiments and examples that are described and/or illustrated in the accompanying drawings and detailed in the following description Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure.

The terms "including", "comprising" and variations thereof, as used in this disclosure, mean "including, but not limited to", unless expressly specified otherwise.

The terms "a", "an", and "the", as used in this disclosure, means "one or more", unless expressly specified otherwise.

Although process steps, method steps, or the like, may be described in a sequential order, such processes and methods may be configured to work in alternate orders. In other words, any sequence or order of steps that may be described does not necessarily indicate a requirement that the steps be performed in that order. The steps of the processes or methods described herein may be performed in any order practical. Further, some steps may be performed simultaneously.

Figure 1A:
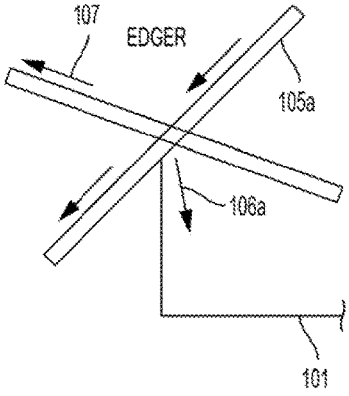
FIG. 1A (Prior Art)
FIGS. 1A and 1B illustrate issues with currently available paint trays, according to the prior art.
Figure 1B:
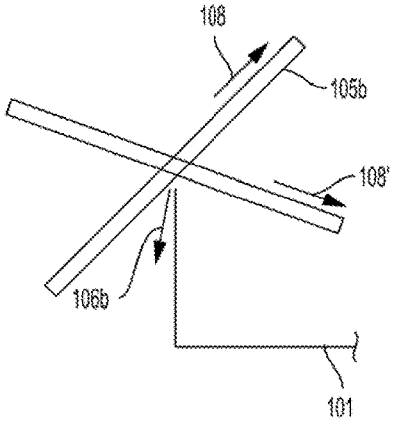
FIG. 1B (Prior Art)

FIGS. 1A and 1B illustrate some issues with currently available paint trays, according to the prior art. When using a paint edger 105*a* or pad, after wetting the pad or edger with paint, a user typically scrapes excess paint from the edger 105*a* on the paint container 101. By way of example, the edger 105*a* shows how an effective use of the edger for removing excess paint might work. A user may pull the paint edger 105*a*, which may be a pad, across the edge of the paint container 101 in a direction 107, as shown, which permits paint to drip into the paint container 101. In contrast, the edger 105*b* is shown being pushed in a direction 108 which causes paint to drip 106*b* outside of the paint container 101.

Figure 2A:
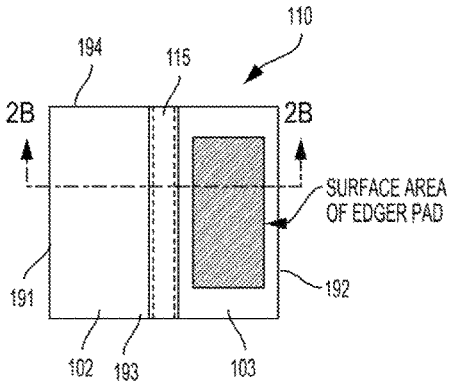
FIG. 2A is a top view and FIG. 2B is a side view of an improved paint container or tray, configured according to the principles of the disclosure.
Figure 2B:
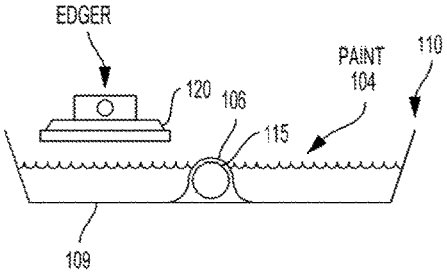
Figure 3A:
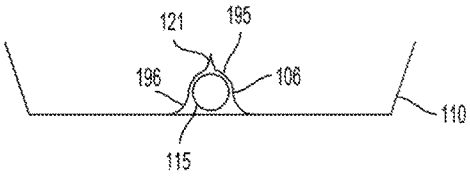
FIGS. 3A-3C show an embodiment of a paint container similar in aspects to FIGS. 2A-2C but includes an additional scraping edge configured on top of the elevated member, configured according to principles of the disclosure.

FIG. 2A is a top view and FIG. 2B is a side view of an improved paint container or tray, configured according to the principles of the disclosure. A paint container 110 which may be a tray or an edger tray, is shown having two halves 102, 103 each being configured to hold and contain a liquid 104, such as, e.g., paint. The paint container 110 may have a plurality of walls 191, 192, 193, 194 to form reservoirs 102, 103 therebetween, and a base 109. Walls 191 and 192 define a length of the paint container. Walls 193 and 194 define a width of the paint container 110. The formed reservoirs 102, 103 may be of equal area, but may be of unequal area. A paint tool 120, such as an edger pad, is illustratively shown and may be immersed at least partially into the liquid 104. The two halves 102, 103 may be separated by an elevated member 106 such as a ridge forming two reservoirs. The elevated member 106 may have a rounded surface. The elevated member 106 may have at least two different radii 195, 196 (FIG. 3A). One radius may be a concave radius 196 near the top of the elevated member 106; the other may be a convex radius 195 formed in relation to the base 109.

A thumb hole 115 may be formed in the elevated member 106. The thumb hole 115 may be configured with a sufficient circumference to permit a human thumb to be inserted therein during use. The thumb hole 115 provides for added stability for a user to hold the paint container 110. The thumb hole 115 may be parallel to walls 191, 192 and may extend the entire length of the paint container. In some applications, the thumb hole 115 may be formed to extend partially along the length of the paint container 110, such as from one or both walls 193, 194. In some embodiments, the thumb hole 115 may be of a first circumference extending from wall 193 for a distance along a length of paint container 110, while a second thumbhole may extend from wall 194 for a distance along a length of paint container 110 but with a second circumference, such as smaller or larger than the first circumference.

Figure 2C:
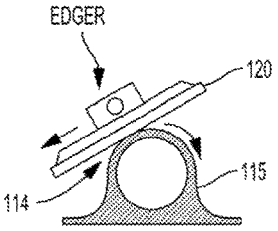
FIG. 2C illustrates using an elevated member for removing excess liquid from a paint tool, according to principles of the disclosure.

FIG. 2C illustrates using elevated member for removing excess liquid from a paint tool, according to principles of the disclosure. As shown in FIG. 2C, the elevated member 106 may be used as a scrape member for removing excess liquid or paint from a paint toll 120, e.g., a pad, edger or paint brush. The scraped excess liquid may be captured by one of the two reservoirs 102, 103. The one or more thumb holes 115 may comprise one or more cavities and may include an aperture wide enough for a user's thumb. This is a significant improvement over currently available paint containers because it improves the manner in which the paint container is usually carried and supported. The cavity may further be configured to be any shape or dimension as needed by a user.

The pail container 110 may include, e.g., polypropylene (PP), thermoplastic elastomer (TPE), metal, wood, polymers, plastic, or the like. The liquid 104 may include, e.g., a paint, a lacquer, a sealer, an ink, a varnish, a stain, a dye, or the like.

The base of the paint container 110 and the sidewalls 191-194 may be formed as one unit. In an alternative, the base 110 and the sidewalls 191-194 may be formed as two separate units that may be connected by, e.g., a screw, tape, nail, adhesive, and the like.

The paint container 110 body may be substantially translucent or transparent. The container body may include a material that is configured to flex in response to a force applied to the container body. The paint container 110 may be rectangular in shape.

The sidewalls 191-194 of the paint container 110 may be of substantially uniform thickness. The base 109 may be a substantially uniform thickness. The thickness of the base 109 may be different from the thickness of the sidewalls 191-194, or may be the same thickness.

Figure 3B:
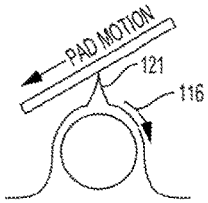
Figure 3C:
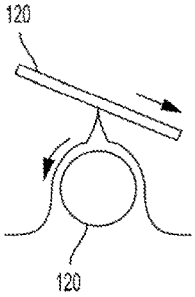
Figure 3D:
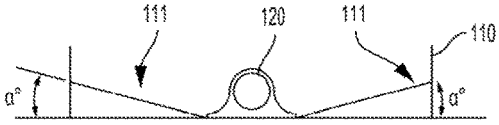
FIG. 3D is an illustration of an embodiment of a paint container, configured according to principles of the disclosure.

FIGS. 3A-3B is an illustration showing an embodiment of a paint container similar in aspects to FIGS. 2A-2C, but includes an additional scraping edge configured on top of the elevated member, configured according to principles of the disclosure. The scraping edge 121 may form a pointed feature that provides an enhanced scraping mechanism, such as, e.g., a triangular-shaped ridge to guide liquid or paint downward 116 into the paint container 110 into a reservoir 102, 103. The scraping edge 121 may be formed along an entire length of the elevated member 106. FIG. 3D is an illustration of an embodiment of a paint container, configured according to principles of the disclosure.

FIG. 3D is similar to FIGS. 2A-2C except for an inclined floor 111 of one or both halves 102, 103, of a pre-determined slope, illustrated as angle $\alpha$. In some applications, FIG. 3D may also include the scraping edged 121.

Figure 4A:
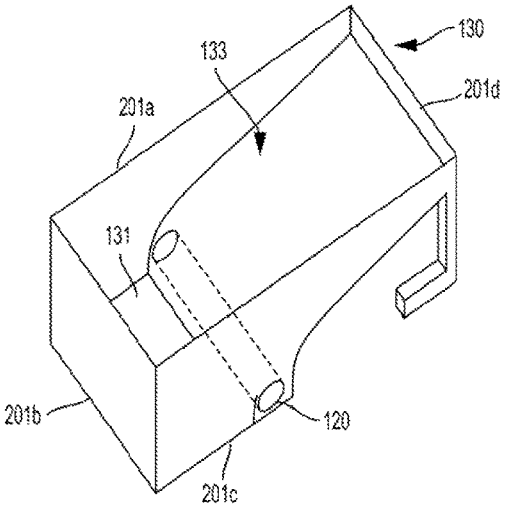
FIG. 4A is a perspective view and FIG. 4B is a side-view showing an illustration of an embodiment of a paint container, which may comprise a roller tray, configured according to principles of the disclosure.
Figure 4B:
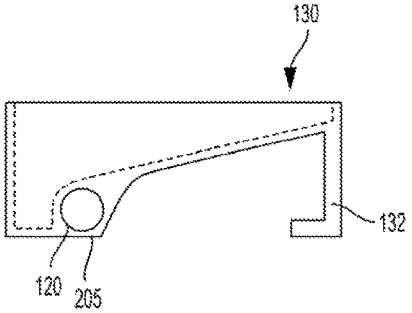

FIG. 4A is a perspective view and FIG. 4B is a side-view showing an illustration of an embodiment of a paint container, which may comprise a roller tray, configured according to principles of the disclosure. The paint container 130 may be configured with a plurality of walls 201*a*, 201*b*, 201*c*, 201*d* and a reservoir 131 for containing a liquid such as paint, stain or the like. The width of walls 201*b* and 201*d* define a width of the paint container 130. The paint container 130 may also include a roller area 133 for permitting a roller (not shown) to be rolled across the surface for spreading the liquid from the reservoir 131 onto the roller. A thumb hole 120 (similar to thumb hole 115) may be formed in one or more sides 201*a*, 201*c* of the paint container 130 parallel to a walls 201*b*, 201*d*, and along the base 205 of the reservoir 131, the base may define an inner wall of the reservoir. The thumb hole 120 may provide for added stability for a user who may insert a thumb into the thumb hole 120 during use. The thumb hole 120 may extend completely across or partially across a width of the paint container 130. There may be two separate thumbs holes 120 extending from each wall 201*a*, 201*c* but extending partially across a width of the paint container 130. A retaining member 132 may be an L-shaped member formed in the paint container 130 for hooking onto a ladder, or the like.

Figure 4C:
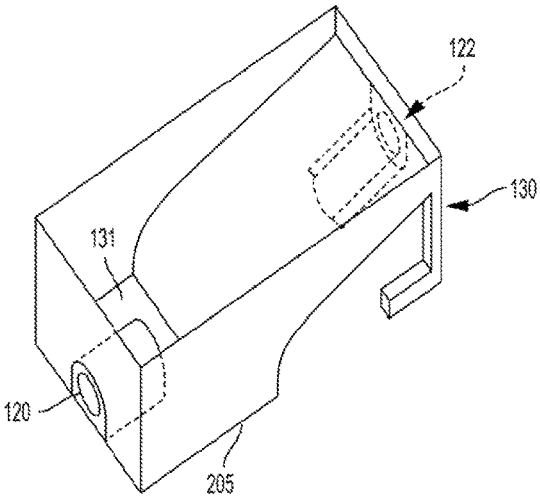
FIGS. 4C and 4D illustrate an embodiment similar to FIGS. 4A and 4B, except holes 120 and 122 are formed at opposing ends of a paint container, configured according to principles of the disclosure.
Figure 4D:
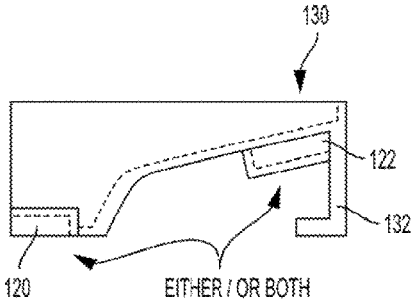

FIGS. 4C and 4D illustrate an embodiment similar to FIGS. 4A and 4B, except holes 120 and 122 may be formed at opposing ends of the paint container 130. Hole 120 (or cavity) may be formed under or along the reservoir 131 and a second hole 122 or cavity may be formed at an opposing end, perhaps proximate the retaining member 132. In this embodiment, both a thumb and a finger may be used to hold the paint container 130 for stability control. In some embodiments, only one hole 120 or 122 may be configured. Hole 120 and hole 122 may be non-parallel to one another. Hole 120 may be formed in wall 201*b*. Hole 122 may be formed below wall 201*d*. Hole 120 may be formed below reservoir 131. Hole 122 may be a second cavity formed proximate the retaining member 132, the retaining member 132 extending downward from the higher or elevated portion of rolling area 133 proximate wall 201*d*.

Figure 5A:
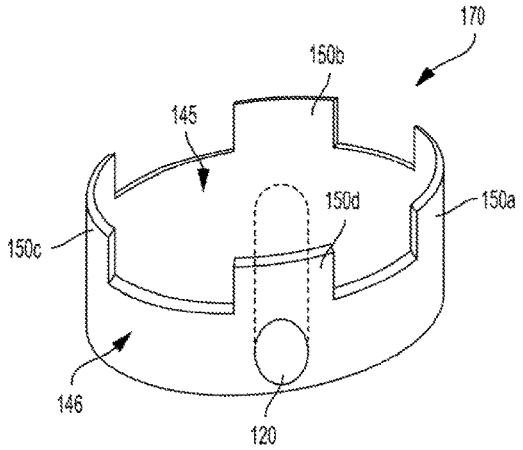
FIG. 5A is an embodiment of a can holder, configured according to principles of the disclosure.
Figure 5B:
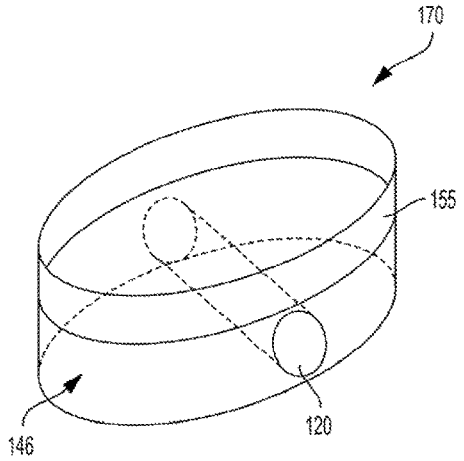
FIG. 5B is an embodiment of a can holder, configured according to principles of the disclosure.
Figure 5C:
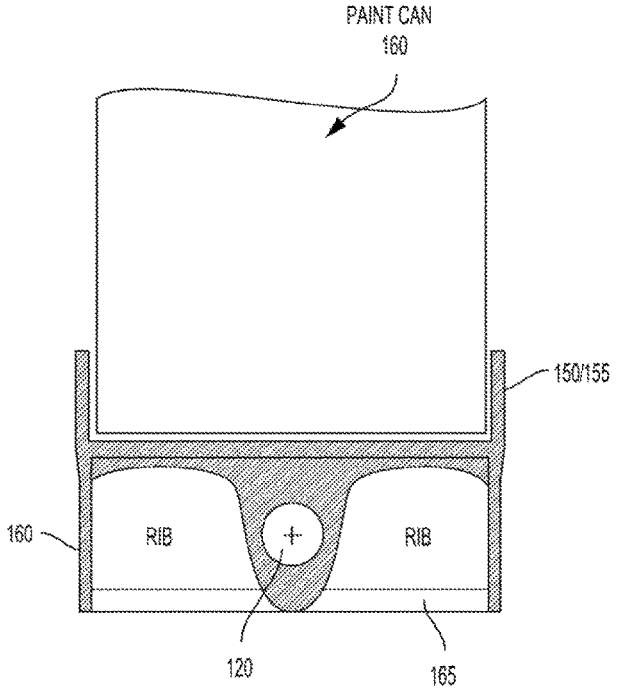
FIG. 5C is a cut-away view of an embodiment of a can holder, configured according to principles of the disclosure.

FIG. 5A is an embodiment of a can holder 170, configured according to principles of the disclosure. A can holder 170 may include a base portion 146 having a circular circumference approximately the same as a can of liquid, or slightly larger. The can of liquid may be a paint can for example. The can may be a typical quart can or may be a different sized can such as a gallon can. The base portion 146 may include a plurality of tab portions 150*a*-150*d* configured around a circumference of the base portion and extending upwardly and located to receive and hold therewithin a can in an area 145 encompassed by the circumference defined by tab portions 150*a*-150*d*. The circumference may be configured to be about the same as a quart or a gallon sized can yet accepts the can by friction fit to hold the can securely. The term "about" in this context (and in FIG. 5B) means nearly the same but may be of a slight variance to permit acceptance of the can therein by friction fit to hold the can securely. The tab portions 150*a*-150*d* may be configured to flex slightly. One or more pairs of tab portions 150*a*/150*c* and/or 150*b*/150*d* may be positioned to oppose in pairs to one another across the circumference of the can. A thumb hole 120 may be configured in the base portion 146 for accepting a thumb or other digit in a cavity of the thumb hole 120. The thumb hole 120 may extend partially or entirely across the width of the base portion 146. In some applications, a thumb and a finger may be inserted at the same time at opposite ends. A user may hold a can of liquid with one hand holding the base portion secured by a finger and/or a thumb inserted into the cavity formed by the thumb hole for use, such as, e.g., during painting. FIG. 5B is similar to FIG. 5A except that the tab portions 150*a*-150*b* are replaced by a lip portion 155 configured to extend around the entire circumference of the base portion 146 and is elevated to receive a can therewithin, i.e., in area 145. FIG. 5C is a cut-away view of a paint holder configured according to principles of the disclosure. A rib member 165 may extend across the base portion 146 for added overall strength. The lip portion 155 and/or the tab portions 150*a*-150*d*, generically shown as 150, may be configured so that a can 160 is held securely therein by friction-fit. The rib member 165 may also serve as a grip point for the thumb or the finger when they are under the can holder 170, if the thumb or the finger does not protrude beyond the full diameter for the can holder 170.

Figure 6A:
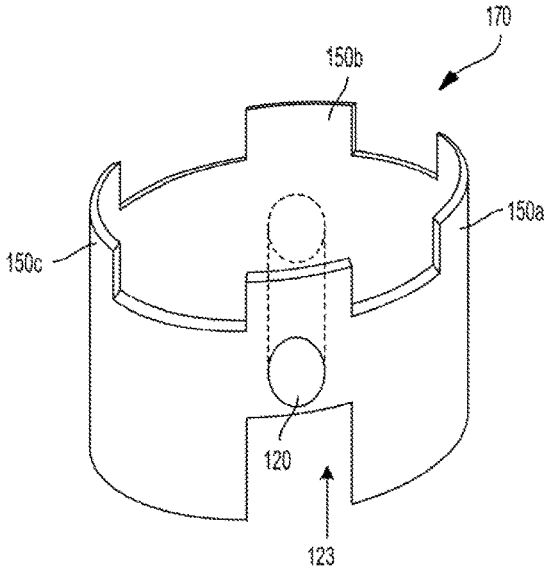
FIG. 6A is an embodiment of a can holder similar to FIG. 5A, configured according to principles of the disclosure.
Figure 6B:
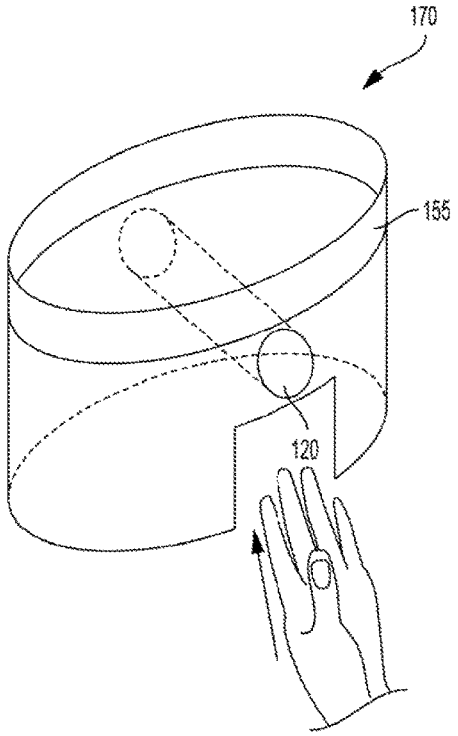
FIG. 6B is an embodiment of a can holder similar to FIG. 5B, configured according to principles of the disclosure.
Figure 6C:
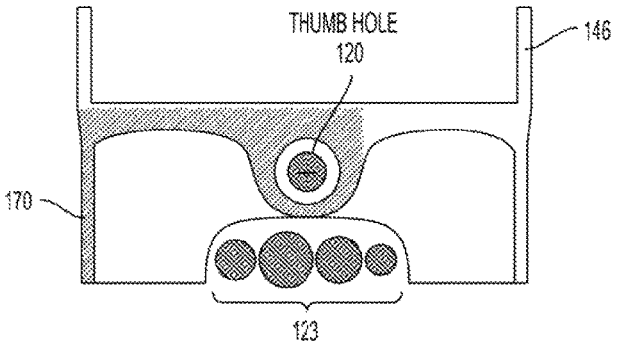
FIG. 6C is a cut-away view of an embodiment of a can holder similar to FIG. 5C, configured according to principles of the disclosure.

FIG. 6A is an embodiment of a can holder similar to FIG. 5A. FIG. 6B is an embodiment of a can holder similar to FIG. 5B. FIG. 6C is a cut-away view of an embodiment of a can holder similar to FIG. 5C, each configured according to principles of the disclosure. FIG. 6A is different from the can holder of FIGS. 5A-5C in that the can holder 170 of FIGS. 6A-6C is taller than the can holder of FIGS. 5A-5C in order to facilitate an opening (or slot) 123 to slide a user's fingers (fingers shown in FIG. 6C in opening 123) underneath while concurrently sliding the user's thumb into the thumb hole 120. The opening 123 may be formed in a lower section of the base portion 146. The opening 123 may accept fingers of a user. The opening 123 may be configured and located below the thumb hole 120. The opening 123 may be recessed permitting simultaneous insertion of a thumb and/or fingers into the can holder 170. This allows the can holder 170 to be placed on a supporting surface and also enables a one-handed operation.

Alternatively, the opening 123 may include at least one (or four) smaller openings that are created into the can holder 170 as to allow a user to insert at least one or more fingers into the can holder 170.

The thumb hole 120 herein may be sized to have a diameter to accept a thumb or digit of a typical person. The diameter may be at least ½ inch, at least ⅝ inch, at least ¾ inch, at least one inch. Alternatively, the diameter of the thumb hole 115, 120 or hole 122, 123 may range from about ½ inch to about 1½ inches. In some embodiments, the diameter of the thumb hole 115, 120, or hole 122, 123 may be less than 1¼ inches. The holes may have different sizes in any embodiment.

Alternatively, the can holder/paint tray/edger tray may include a thumb hole which may further include one constant diameter. In another embodiment of the present disclosure, the can holder/paint tray/edger tray may include at least two different straight, parallel, concentric thumb hole sizes that meet at some point across the diameter/width. In another embodiment of the present disclosure, the can holder/paint tray/edger tray may include two different straight parallel, non-concentric thumb hole sizes that meet at a point across the diameter/width. In yet another embodiment of the present disclosure, the can holder/paint tray/edger tray may include progressively changing hole sizes along the length of the aperture, varying from one diameter to a second diameter.

Figure 7A:
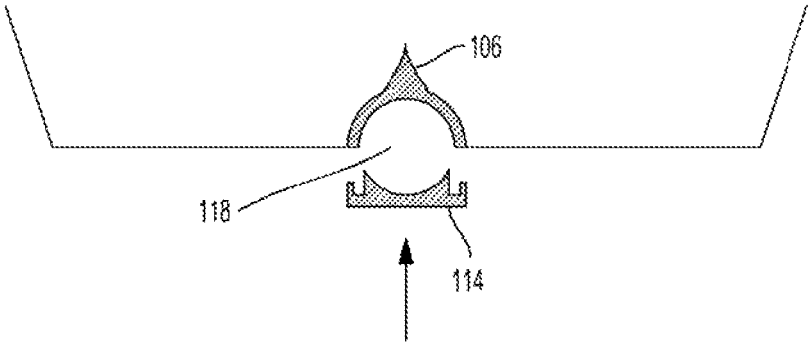
FIGS. 7A-7B are illustrations showing a technique for providing a thumb hole for pail containers as disclosed herein.
Figure 7B:
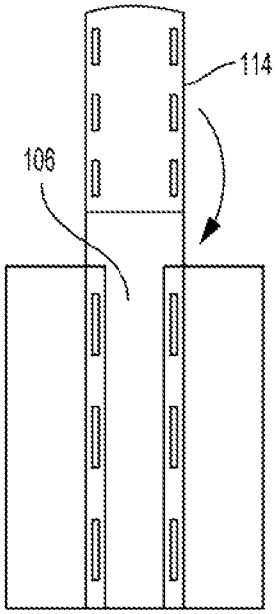

FIGS. 7A-7B are illustrations showing a technique for providing a thumb hole for pail containers as disclosed herein, configured according to principles of the disclosure. The FIG. 7A shows a side view of a paint container which includes the elevated member 106 of the paint container 110 in FIGS. 2A-3D. FIG. 7B shows a top view of the paint container. The paint container may include a cover piece 114 which may be designed to be molded separately and snapped into place over an aperture 118 to produce the thumb 'tunnel' or thumb hole as shown in FIGS. 7A and 7B.

While the disclosure has been described in terms of exemplary embodiments, those skilled in the art will recognize that the disclosure can be practiced with modifications in the spirit and scope of the appended claims. These examples are merely illustrative and are not meant to be an exhaustive list of all possible designs, embodiments, applications or modifications of the disclosure.

What is claimed is:

1. A container comprising a container body that comprises:

a base having a tubular portion that extends vertically from a plane on which the base rests, the base having at least one vertical extension extending from the base about a circumference of the base; the vertical extension sized to accept a can therebetween to provide stability to the can;

a cavity formed along a side of the tubular portion, wherein the cavity extends vertically along an exterior portion of the side and across a width of the base configured of sufficient diameter to receive a thumb of a user therein, wherein a diameter of the base is about the same as a diameter of a mating quart can or a mating gallon can permitting acceptance of the mating can therein.

2. The container of claim 1, wherein the at least one vertical extension is a continuous vertical extension extending vertically from a circumference of the base and configured to hold a can of liquid therein by friction fit.

3. The container of claim 1, wherein the cavity is sized to accept a thumb of a user.

4. The container of claim 1, wherein the cavity is sized to accept four fingers of a user.

5. The container of claim 1, wherein the cavity forms an opening through the side of the tubular portion of the base.

* * * * *